US006305438B1

(12) United States Patent
Sjöholm et al.

(10) Patent No.: US 6,305,438 B1
(45) Date of Patent: Oct. 23, 2001

(54) FILLING METHOD AND FILLING DEVICE

(75) Inventors: Johan Sjöholm, Lund; Ulf Mossberg, Löddeköpinge, both of (SE)

(73) Assignee: Ecolean AB, Helsingborg (SE)

( * ) Notice: Subject to any disclaimer, the term of this patent is extended or adjusted under 35 U.S.C. 154(b) by 0 days.

(21) Appl. No.: 09/622,438

(22) PCT Filed: Feb. 17, 1999

(86) PCT No.: PCT/SE99/00203

§ 371 Date: Nov. 9, 2000

§ 102(e) Date: Nov. 9, 2000

(87) PCT Pub. No.: WO99/41149

PCT Pub. Date: Aug. 19, 1999

(30) Foreign Application Priority Data

Feb. 17, 1998 (SE) ..... 9800451

(51) Int. Cl.[7] ..... B65B 1/04; B65B 3/04

(52) U.S. Cl. ..... 141/2; 141/83; 141/114; 141/115; 141/192; 251/9; 222/571

(58) Field of Search ..... 141/2, 83, 94, 141/114, 115, 116, 192, 264; 251/4, 6, 9; 222/571; 604/32, 248, 250

(56) References Cited

U.S. PATENT DOCUMENTS 4,401,141 8/1983 Rosen et al. .
4,524,944 * 6/1985 Sussman ..... 251/6
5,402,823 * 4/1995 Cole ..... 137/594
5,458,581 * 10/1995 Hull ..... 604/248

FOREIGN PATENT DOCUMENTS

A1-4126136 2/1993 (DE) .
A1110189 6/1984 (EP) .

OTHER PUBLICATIONS

Derwent's Abstract, No. 93–195008/24, Week 9324 SU 1742131 (Jun. 23, 1992).

* cited by examiner

*Primary Examiner*—Timothy L. Maust
(74) *Attorney, Agent, or Firm*—Birch, Stewart, Kolasch & Birch, LLP

(57) ABSTRACT

A filling device (100) for filling a container (1) with a liquid has a filling duct (15) which is connected to a storage tank. On a carrying means (10) there are arranged a deformable tube (20) which forms a throttle portion (22) in the duct (15), and a squeezing means (30) which is arranged along the tube and which is adapted to act on the sides of the tube (20) and which, when operated to close the duct, is adapted to move countercurrently to generate a subatmospheric pressure in the duct (15) downstream of the squeezing means (30). The filling device also has a meter for measuring a discharged amount of liquid. In a method of filling the container, the duct (15) opens by the squeezing means (30) being moved from a squeezing position and the amount of liquid transferred to the container (1) being measured, whereupon the squeezing means (30) is returned to the squeezing position, the squeezing means being moved countercurrently to generate a subatmospheric pressure in the duct (15) downstream of the squeezing means (30).

14 Claims, 2 Drawing Sheets

FILLING METHOD AND FILLING DEVICE

This application is the national phase under 35 U.S.C. §371 of PCT International Application No. PCT/SE99/00203 which has an International filing date of Feb. 17, 1999, which designated the United States of America.

FIELD OF THE INVENTION

The present invention relates to a method of filling a container with a liquid and a filling device therefor.

BACKGROUND ART

The filling of containers with liquids, such as dairy products, today places high demands on a hygienic environment. Aseptic conditions are required when the products contain bacteria which could multiply and become a health hazard.

The currently used methods for filling containers with liquids are based on the liquid being stored in a main tank. In order to transfer the correct amount of liquid to each container, the liquid is first transferred from the main tank to a number of separate balance tanks. Then the liquid is transferred from the balance tank to a container. In the balance tank, especially in corners and along edges where the liquid is stagnant, and in connections to and from the tank, bacteria in the liquid tend to grow and multiply, which in turn may cause cultures injurious to health. This means that it is necessary to continuously clean a large number of balance tanks to retain an aseptic environment and to avoid health hazards caused by bacteria in the final product, for instance in milk.

The balance tanks are in many cases equipped with some sort of level monitor which monitors that the correct amount of liquid is transferred from the main tank. The liquid is transferred between the tanks through conduits and the flow is controlled by means of valves, in which bacteria cultures can also grow.

SUMMARY OF THE INVENTION

An object of the present invention is to obviate or reduce the hygienic problems that exist in the current technique when liquid foodstuffs are to be packed.

A further object is to provide a simple device for filling a container with liquid.

These objects are achieved by a method and a device according to claims 1 and 8, respectively.

According to the invention, a flow of liquid is thus controlled in filling by means of a squeezing device, which acts on a deformable tube and which when being returned to a squeezing position is moved countercurrently to produce a subatmospheric pressure in the tube downstream of the squeezing position.

Such a valve structure obviates stagnant accumulations of liquid where bacteria can thrive.

The returning of the squeezing means against the deformable tube comprises the step of producing a back suction in the tube downstream of the squeezing means by moving the squeezing means countercurrently to the squeezing position. When the liquid ceases to flow, the back suction in the tube makes the liquid stay in the lower portion of the tube, thereby preventing dripping.

According to a preferred embodiment, the tube has a self-closing nozzle which is inserted into the container to let the liquid flow into the same. This reduces the risk of liquid spillage during the transfer of liquid to the container. A good fit between the nozzle and the container prevents liquid from contacting the surroundings. Preferably, the nozzle is made of an elastically deformable material. As a result, its self-closing function can be accomplished by designing it in such manner that its outlet opens when a pressure is applied, i.e. by turning on the flow of liquid. Preferably, the cross-sectional opening of the inlet of the nozzle is larger than the cross-sectional opening of the outlet of the nozzle in its fully open state. This results in a pressure above atmospheric in the nozzle. This pressure above atmospheric together with the elastic deformability of the nozzle ensures an additionally improved fit between the nozzle and the container.

The back suction in the tube also causes the aperture of the nozzle to close, which prevents the liquid from contacting the surroundings during periods between filling operations.

By an amount of liquid transferred to a container being measured with the aid of a meter, it is possible to control the squeezing action of the squeezing device on the tube and fill the container with a correct amount of liquid.

The need for balance tanks, which have surfaces and edges where bacteria can grow, thus disappears, and it becomes easier to maintain an aseptic environment. When the tube is squeezed, the flow of liquid is prevented, without any edges or surfaces forming where cultures of bacteria can grow. When the flow is once more turned on, there is no area with stagnant liquid left. According to the invention, a device is provided, which in terms of construction can be made considerably simpler than previous constructions including balance tanks.

The deformable tube can, by being subjected to different degrees of outer pressure, change the flow of liquid to the container, which makes it possible to reduce the number of valves through which the liquid passes and to facilitate cleaning. The tube is easy to clean and can also readily be replaced when required to maintain a hygienic environment.

The method and the device according to the invention further make it possible to add gaseous additives to the liquid. Up to now, this has been made difficult by great leakage in, inter alia, balance tanks. It is, for instance, desirable to be able to add small amounts of carbon dioxide to milk to improve its keeping qualities. With previous filling methods, this has been difficult to achieve at a reasonable cost, since such adding has been associated with considerable spillage of carbon dioxide.

Preferred embodiments of the invention are evident from the dependent claims.

In a preferred embodiment of these invention, the measurement of the amount of liquid comprises the steps of beginning the measurement at the same time as the duct opens and terminating the measurement when a predetermined amount has been measured. It is particularly preferred that the duct is closed in response to a predetermined amount being measured. Thus, the transferred amount is accurately controlled.

A preferred method of measuring the transferred amount of liquid to the container comprises the step of measuring the time during which the liquid flows from the tank to the container. The time in which the liquid is allowed to flow through the tube decides how much liquid is transferred to the container. If the pressure of the liquid through the duct is kept essentially constant, a time-based measurement will be very easy and useful.

Another preferred method of measuring the transferred amount of liquid to the container comprises the step of measuring by means of a flow meter the flow of liquid through the filling duct and simultaneously calculating the transferred amount.

A third preferred method of measuring the transferred amount of liquid to the container comprises the step of weighing of the container together with the amount of liquid that has been transferred to the same.

The step of making the liquid flow into the container by opening the filling duct comprises advantageously the step of supplying of a gas to the flowing liquid when being transferred to the container. A gas supplying device is then arranged in the duct for supplying gas directly to the liquid during filling. Supplying a gas in connection with the final filling of the container results in a reduction of the total amount of consumed gas since the losses are considerably smaller than in methods that have been used up to now. The reduced consumption of gas leads to lower costs and to the fact that new fields of application become realistic.

BRIEF DESCRIPTION OF THE DRAWINGS

The invention will now be described in more detail with reference to the accompanying drawings which for the purpose of exemplification illustrates a currently preferred embodiment.

DESCRIPTION OF A PREFERRED EMBODIMENT

Figure 1:
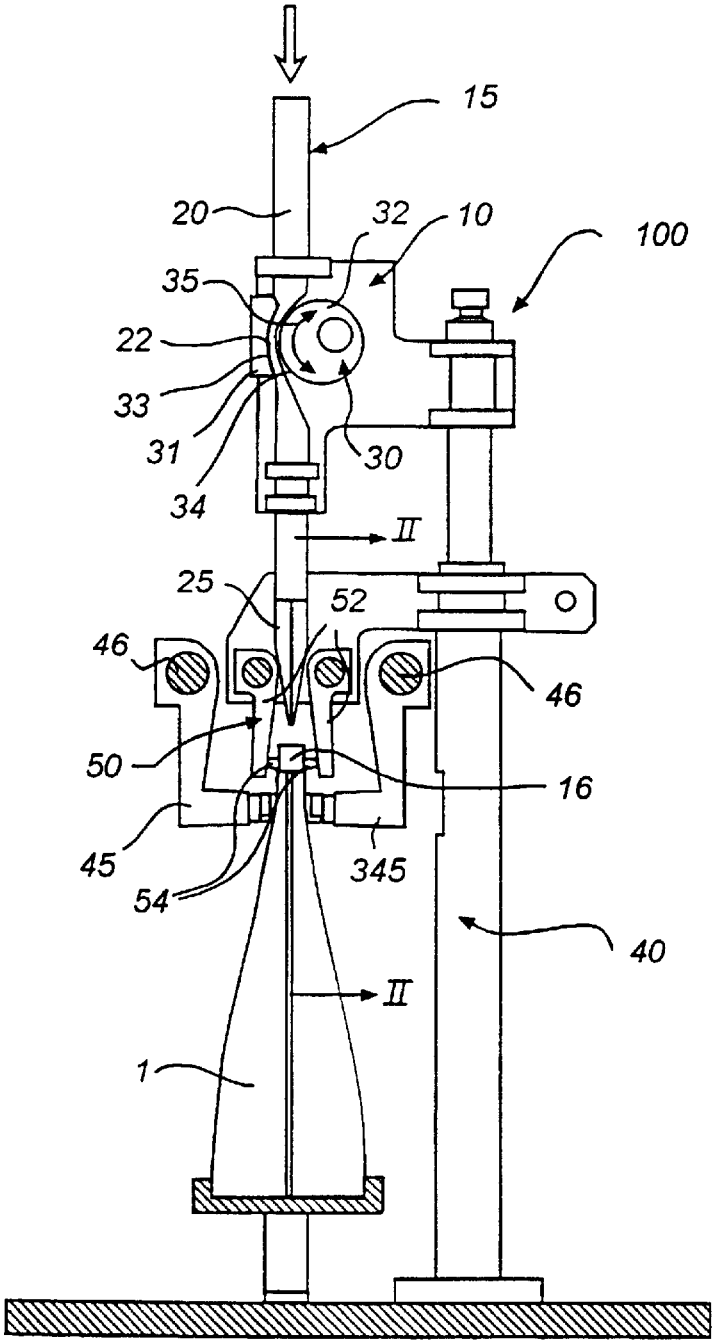
FIG. 1 is a side view of a filling device with certain parts removed for better clarity.

FIG. 1 is a side view, seen in the travelling direction of a web of containers, of a device 100 for filling a container 1 preferably with a liquid. The device will be described below with reference to milk, but is also suited for filling with other liquids and pulverulent substances.

The filling device 100 comprises a frame 40 and a vertically adjustable carrying means; 10 arranged thereon and shown in a raised position. Moreover, the filling device 100 comprises a filling duct 15 which is connected to a storage tank (not shown) and which consists of a deformable tube 20 with a filling nozzle 25 at its lower end, and a squeezing means 30 which is arranged round a throttle portion 22 of the tube 20 and which comprises a supporting device 31 arranged at a first side of the tube 20 and a squeezing member 32 arranged at the opposite side of the tube 20. For better clarity, a number of components of the filling device 100 in FIG. 1 have been omitted.

The supporting device 31 of the squeezing means 30 is fixedly connected to the carrying means 10 and forms a concavely curved squeezing surface 33 facing the tube 20. The squeezing member 32 is circular and suspended from the carrying means 10 in an asymmetrically pivotable manner. Thus, the squeezing member 32 forms a convex squeezing surface 34 facing the tube 20 and the supporting device 31. The squeezing member 32 is pivotable in the manner indicated by the double arrow 35 and thus opens the duct 15 by a combined motion downstream and outwardly away from the tube 20 and closes the duct 15 by a combined motion upstream inwardly towards the tube 20. By closing occurring in a combined squeezing motion and upstream motion, a subatmospheric pressure is generated in the tube 20 downstream of the squeezing means 30, thereby preventing dripping when the duct 15 is closed.

The carrying means 10 which carries the tube 20 and the squeezing means 30 is vertically adjustable in the frame 40 in such manner that the filling nozzle 25 can be inserted into a duct means 16 of a container 1 to begin the filling operation and can be removed from the duct means 16 of the container 1 after filling.

On the frame 40, there is arranged an opening means 50 in the form of two pivotable opening arms 52, at the ends of which suction cups 54 are mounted. The suction cups are connected to a vacuum source. By pivoting, by means of the opening arms 52, the suction cups 54 to the sides of the duct means 16 of the container 1 and then applying a subatmospheric pressure to the suction cups 54 while at the same time the opening arms 52 are pivoted slightly outwards, the duct means 16 opens so that the filling nozzle 52 can be inserted into the same, which is effected by moving the carrying means 10 downwards.

Figure 2:
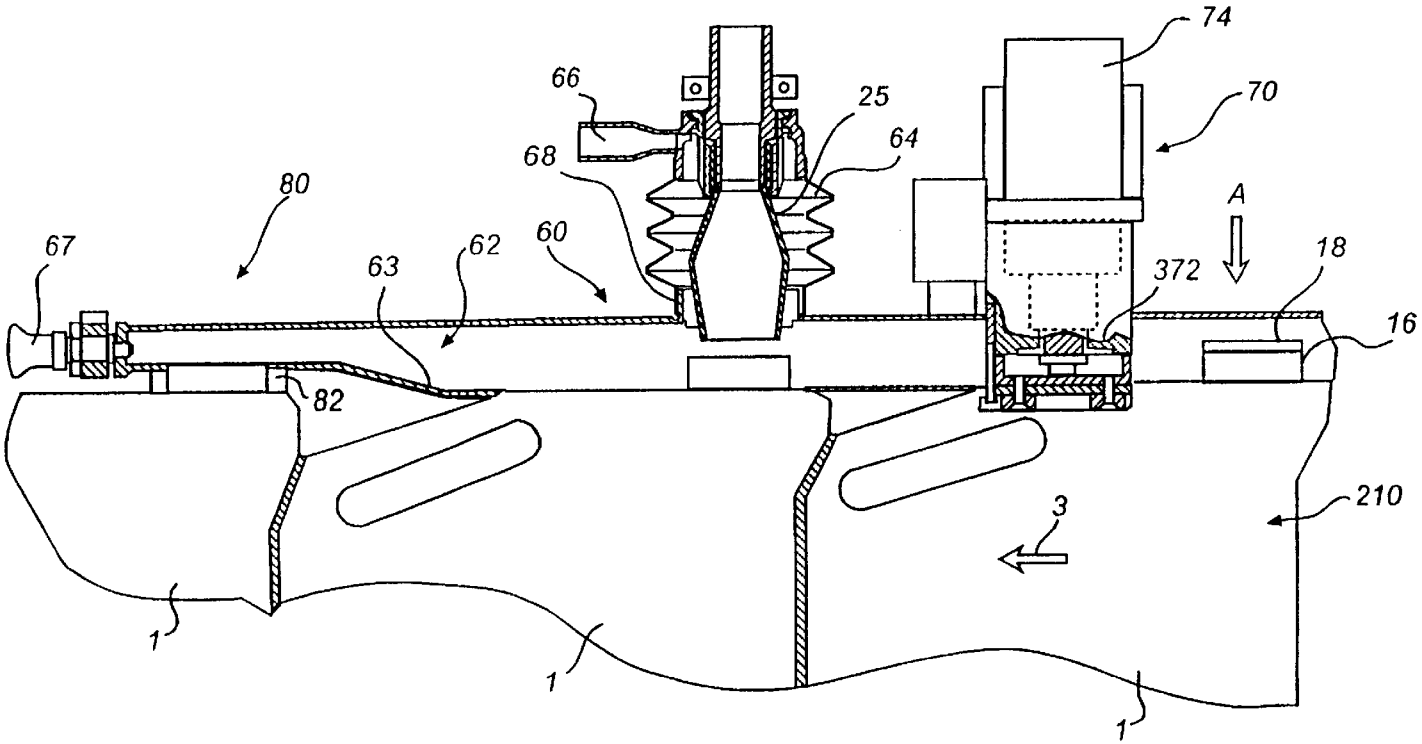
FIG. 2 is a longitudinal section of the filling device along line II—II in FIG. 1.

FIG. 1 also illustrates a pair of conveying arms 45 which are arranged on rotatable conveying rods 46 which are adapted to reciprocate. When conveying a web 210, as shown in FIG. 2, of containers 1, the conveying arms 45 are pivoted to engage the web 210, whereupon the conveying rods 46 perform a striking motion in the travelling direction of the web 210 to move the web 210. Subsequently, the conveying arms 45 are pivoted away from the web 210 and the conveying rods 46 are returned to the starting position to repeat the procedure.

FIG. 2 is a side view of a filling device 100 as shown in FIG. 1. Also in this Figure, some components have been omitted for better clarity. There is shown a chamber 60 which is arranged around the filling nozzle 25 and the duct means 16 of the containers 1 to provide an aseptic filling environment. The compartment 60 comprises a rail 62, in which the duct means 16 is guided, a bellows 64 surrounding the filling nozzle 25, and a delivery duct 66 for a sterile gas, such as hot sterile air.

FIG. 2 also illustrates a web 210 of containers 1 of a flexible plastic material, which are conveyed into the filling device 100 in the direction of arrow 3, which is the travelling direction of the web. The containers 1 are collapsible and comprise flexible walls which are interconnected to form a compartment whose volume depends on the relative position of the walls. The duct means 16 is arranged between two side walls and extends from the compartment to the outside of the container 1. In position A, a sealed container 1 is shown, the duct means 16 of which is sealed in its outer end portion 18. A cutting device 70 with a motor 74 and a rotary cutting blade 72 which is arranged on each side of the web 210 and of which only one is shown, is mounted in the rail 16 to open the container 1 by cutting off the sealed end portion 18 of the duct means 16.

After the cutting device 70, seen in the travelling direction 3, there is a filling station with the filling nozzle 25 of the filling duct 15 and one step further, there is a sealing station 80 (not shown) comprising two hot press jaws 82 to seal the duct means 16 of the filled containers 1.

The rail 62 is elongate and has an essentially vertical rectangular cross-section with a slot 63 which is formed in its underside and in which the duct means 16 is guided. The slot 63 is adjacent to the filling nozzle 25 expanded to an elliptic opening to allow opening of the duct means 16 and insertion of the filling nozzle 25 into the same. Furthermore, the rail 62 comprises adjacent to the filling nozzle 25 a cylindrical connecting portion 68 arranged on its upper side and intended for the bellows 64.

Figure 3:
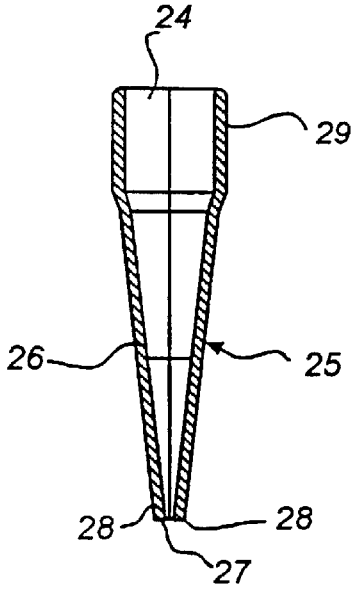
FIG. 3 is a sectional view of a nozzle associated with the filling device.

The filling nozzle 25, which is shown in more detail in FIGS. 2 and 3, has an end portion 26 of elongate cross-section, which in its transverse direction tapers off to an elongate outlet 27 with opposing edge portions 28 which engage each other. The end portion 26 also tapers slightly in the longitudinal direction of the elongate cross-section, as is evident from FIG. 2. The filling nozzle 25 is made of an elastically deformable material, such as an elastic plastic, preferably silicone rubber, and is self-closing, i.e. the edge portions 28 of the outlet 27 engage each other to seal the outlet 27 in the absence of application of outer forces. Such application of outer forces is achieved, for instance, by turning on the flow of liquid, thus enabling the liquid pressure to open the nozzle. The outlet 27 of the nozzle is in its fully open state smaller than the inlet 24 of the nozzle. This results in a pressure above atmospheric in the nozzle 25, which thus expands and is pressed against the duct means of the container 1. The filling nozzle has at its end facing away from the end portion 26 a connecting portion 29 to be connected to the filling duct 15. A thus designed filling nozzle 25 is particularly suitable to be inserted into the duct means 16 of the container 1 and seal against the inside thereof.

Figure 4:
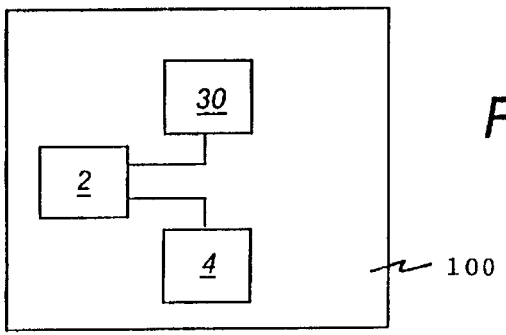
FIG. 4 is a block diagram of the filling device.

As shown in FIG. 4, the filling device 100 also comprises a control means 2 which controls the opening and closing of the duct 15 with the squeezing means 30. The control means 2 is also connected to a meter 4 for measuring the passing amount of liquid. The control means 2 is adapted to start measuring at the same time as the duct 15 opens and to close the duct 15 in response to a predetermined amount being measured. The meter 4 can, as will be described in more detail below, be designed in one of a plurality of different ways, for instance, for weighing the container 1 during filling, measuring the volume flowing through the duct 15 or measuring the time passing after opening of the duct 15.

In operation of the filling device 100, sterile gas flows into the bellows 64 through the delivery conduit 66 and further into the rail 62. The gas then escapes through the slot 63. The bellows 64 permits a sterile environment at the filling station around the filling nozzle 25 while at the same time the nozzle can be raised and lowered unimpededly. With the chamber 60 it is ensured in an easy and reliable manner that filling occurs in a sterile environment.

When filling an empty and previously sterilized container 1, it is first inserted into the sterile environment in the rail 62, whereupon the container 1, which at this stage is collapsed and empty, is opened in the cutting device 70. The open container 1 is then conveyed to the filling nozzle 25, adjacent to which the opening means 50 expands the duct means 16 and the filling nozzle 25 is moved down and into the same. In this connection, the squeezing means 30 opens and the container 1 is filled with milk, which increases the volume thereof, the meter 4 beginning to measure the amount of liquid supplied to the container. When a predetermined amount has been measured, the squeezing means 30 closes in response thereto. In closing, a subatmospheric pressure forms in the tube 20 adjacent to the filling nozzle 25, and therefore its outlet 27 is sealed. The container 1 is then conveyed further to the sealing station 80 where it is sealed once more.

In a preferred method, the measuring operation is carried out by measuring with the aid of a weighing means (not shown) on which the container 1 is placed or from which it is suspended during the filling process. When the container reaches a predetermined weight, a signal is given to the control means 2, which in turn controls the squeezing means 30 to closing.

In a further preferred method, the measuring operation is carried out by the volume flowing through the duct 15 being measured by means of a flow meter (not shown) with a calculating unit (not shown) connected thereto and adapted to calculate the passing volume and emit a signal to the control means 2 when the predetermined volume has been reached.

In one more preferred embodiment of the invention, the measuring operation is carried out by measuring the time passing from the moment the squeezing means opens. At a predetermined point of time, a signal is emitted to the control means. In this embodiment, use is made of the fact that the flow through the duct is relatively constant when the squeezing means is open. In a particularly preferred embodiment, a weighing means is arranged after the filling station for check weighing. When required, a feed-back coupling is effected in case of deviations from a predetermined volume for any adjustments of the predetermined time.

In a preferred embodiment of this filling device, a means for supplying carbon dioxide is arranged in the filling duct. It is particularly preferred that this supply means is connected to the control means in such manner that the supply occurs directly to the duct only when the duct is open and liquid flows into the container.

What is claimed is:

1. A method of filling through a filling duct (15) a container (1) with a liquid from a storage tank, characterized by the steps of opening the duct (15) in a throttle portion (22) which is contained therein and in which the duct (15) comprises a deformable tube (20), by moving a squeezing means (30) acting on the sides of the tube (20), from a squeezing position, measuring the amount of liquid transferred to the container (1) and closing the duct (15) by returning the squeezing means (30) to the squeezing position, the squeezing means being moved countercurrently to generate a subatmospheric pressure in the duct (15) downstream of the squeezing means (30).

2. A method as claimed in claim 1, wherein the step of measuring the amount of liquid comprises the steps of beginning the measuring operation at the same time as the duct (15) is opened, and terminating the measuring operation when a predetermined amount has been measured.

3. A method as claimed in claim 1, wherein the step of closing the duct (15) is carried out in response to a predetermined amount being measured.

4. A method as claimed in claim 1, wherein the step of measuring the amount of liquid comprises measuring the time passing after the duct (15) has been opened.

5. A method as claimed in claim 1, wherein the step of measuring the amount of liquid comprises measuring the liquid flow in the duct (15).

6. A method as claimed in claim 1, wherein the step of measuring the amount of liquid comprises weighing the container during the filling operation.

7. A method as claimed in claim 1, wherein a gas is supplied to the flowing liquid when the duct (15) is open.

8. A filling device (100) for filling a container (1) with a liquid, comprising a filling duct (15) connected to a storage tank, characterized by a throttle portion (22) associated with the duct and comprising a deformable tube (20), a squeezing means (30) which is arranged along the tube (20) and which is adapted to act on the sides of the tube (20) and which, when operated to close the duct, is adapted to move countercurrently to generate a subatmospheric pressure in the duct (15) downstream of the squeezing means (30), and a meter for measuring a discharged amount of liquid.

9. A filling device as claimed in claim 8, which has a control means which is connected to the squeezing means (30) and the meter and intended to control the supply of liquid.

10. A filling device as claimed in claim 8, wherein the squeezing means (30) comprises a supporting device (31) arranged at a first side of the tube (20) and a squeezing means (32) arranged at the opposite side of the tube (20) and being movable against the supporting device (31) to squeeze the tube (20).

11. A filling device as claimed in claim 10, wherein the supporting device (31) is elongate and the squeezing means (32) is pivotable, the squeezing means (32) having a rounded surface (34) facing the tube (20).

12. A filling device as claimed in claim 8, characterized by a filling nozzle (21) which is mounted at one end of the tube and which has a self-closing outlet (27) and is adapted to be inserted in the container (1) when filling the same.

13. A filling device as claimed in claim 12, characterized in that the filling nozzle (25) is at least partly made of an elastically deformable material.

14. A filling device as claimed in claim 13, characterized in that the filling nozzle (25) has an inlet (24), whose cross-sectional opening is larger than the cross-sectional opening of the outlet (27) in its fully open state.

* * * * *